US005839243A

United States Patent [19]

Martin

[11] Patent Number: 5,839,243

[45] Date of Patent: Nov. 24, 1998

[54] INTERLOCKING AND INSULATED FORM PATTERN ASSEMBLY FOR CREATING A WALL STRUCTURE FOR RECEIVING POURED CONCRETE

[75] Inventor: Robert J. Martin, Oakland Township, Mich.

[73] Assignee: New Energy Wall Systems, Inc., Royal Oak, Mich.

[21] Appl. No.: 713,522

[22] Filed: Sep. 13, 1996

[51] Int. Cl.[6] ..... E04B 2/20

[52] U.S. Cl. ..... 52/439; 52/309.12; 52/309.16; 52/302.4; 52/505; 52/592.6

[58] Field of Search ..... 52/309.12, 426, 52/439, 564, 310, 309.16, 302.1, 302.4, 436, 592.6, 565, 568

[56] References Cited

U.S. PATENT DOCUMENTS

| | | | |
|---|---|---|---|
| 1,719,749 | 7/1929 | Berman | 52/302.4 X |
| 1,746,816 | 2/1930 | Boes | 52/302.4 X |
| 2,392,551 | 1/1946 | Roe | 52/592.6 X |
| 2,749,739 | 6/1956 | Zagray | 52/592.6 X |
| 3,391,507 | 7/1968 | Downing | 52/302.4 X |
| 3,534,518 | 10/1970 | Zagray | 52/592.6 X |
| 3,788,020 | 1/1974 | Gregori | 52/439 X |
| 4,075,808 | 2/1978 | Pearlman | 52/439 |
| 4,433,521 | 2/1984 | Dietrich | 52/302.4 |
| 4,439,967 | 4/1984 | Dielenberg | 52/439 X |
| 4,473,985 | 10/1984 | Hunt | 52/592.6 |
| 4,565,043 | 1/1986 | Mazzarese | 52/592.6 |
| 4,694,624 | 9/1987 | Juhas | 52/309.11 X |
| 4,852,319 | 8/1989 | Cowan | 52/310 X |
| 4,884,382 | 12/1989 | Horobin . | |
| 4,894,969 | 1/1990 | Horobin . | |
| 5,024,035 | 6/1991 | Hanson et al. . | |
| 5,086,600 | 2/1992 | Holland et al. | 52/309.12 X |
| 5,123,222 | 6/1992 | Guarriello et al. . | |
| 5,274,968 | 1/1994 | Pardo | 52/302.4 X |
| 5,459,971 | 10/1995 | Sparkman | 52/105 X |
| 5,465,542 | 11/1995 | Terry | 52/309.12 X |
| 5,568,710 | 10/1996 | Smith et al. | 52/309.11 X |

*Primary Examiner*—Christopher Kent
*Assistant Examiner*—Yvonne Horton-Richardson
*Attorney, Agent, or Firm*—Gifford, Krass, Groh, Sprinkle, Patmore, Anderson & Citkowski, P.C.

[57] ABSTRACT

An interlocking and insulated form pattern assembly for creating a wall construction for receiving a poured concrete. A plurality of form structures each are constructed in a substantially rectangular fashion with a height, length and width and include pluralities of arcuately shaped inner walls which define both vertically and longitudinally extending concrete filling passageways. The forms are interlockingly arranged according to a desired stacking arrangement so that the vertically and longitudinally filling passageways extending continuously throughout the erected wall structure. Moisture drainage channels likewise extend in interconnected fashion both horizontally and vertically within the form structures and are arranged in alignment with identical channels in succeeding form structures to provide internal drainage capabilities to the form assembly.

15 Claims, 5 Drawing Sheets

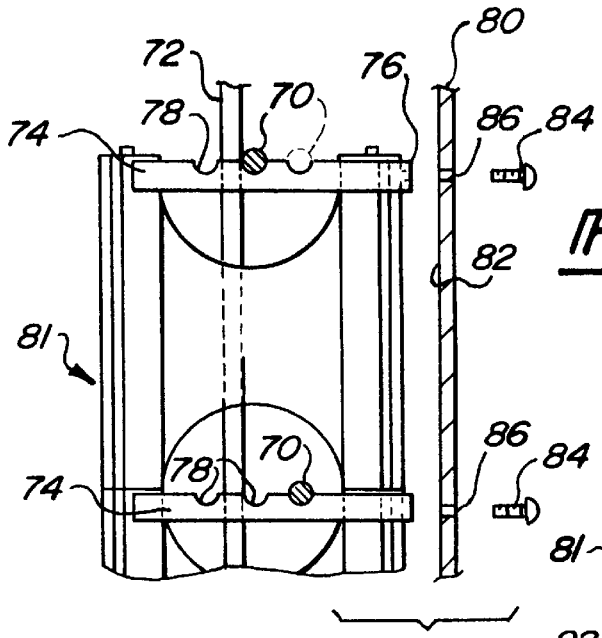
Fig-3
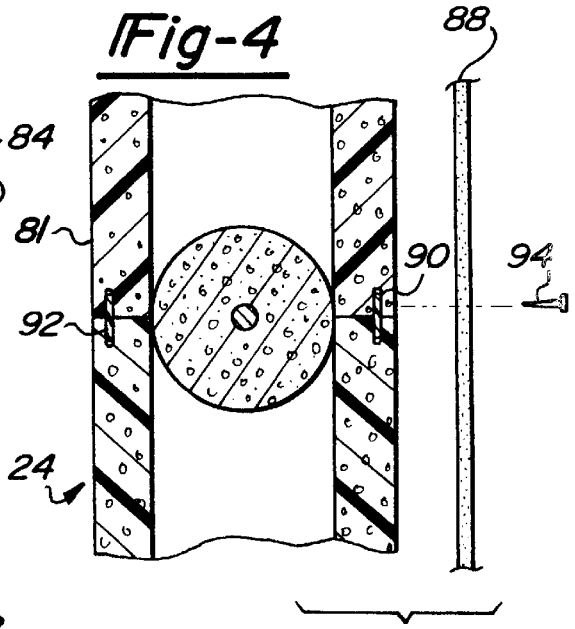
Fig-4
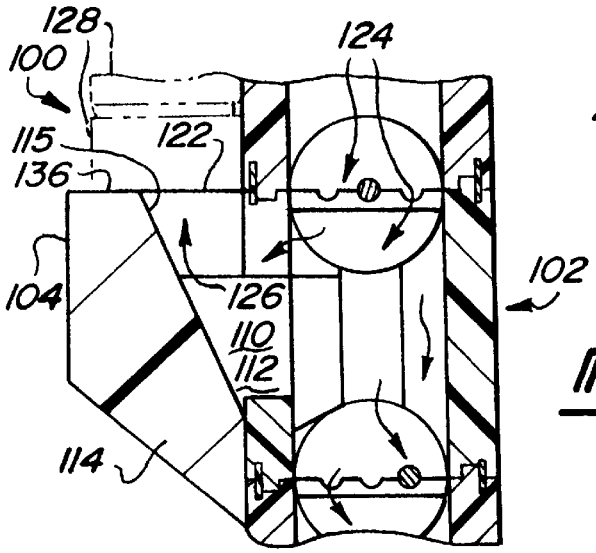
Fig-8
Fig-5
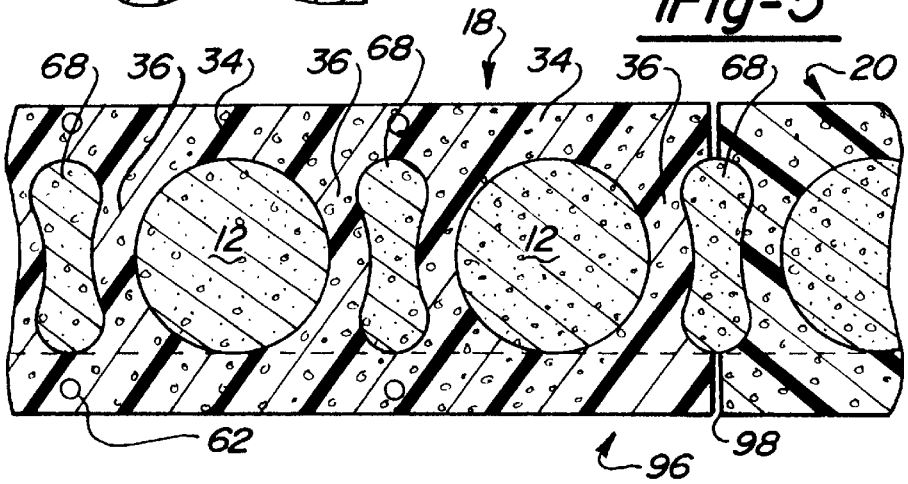

INTERLOCKING AND INSULATED FORM PATTERN ASSEMBLY FOR CREATING A WALL STRUCTURE FOR RECEIVING POURED CONCRETE

BACKGROUND OF THE INVENTION

1. Field of the Invention

The present invention relates generally to insulating block forms having hollowed interiors which are used in creating wall structures for receiving a poured concrete and, more particularly, to an improved interlocking and insulated form pattern assembly for creating such a wall structure while providing superior stress and load distributions as well as moisture drainage capabilities.

2. Description of the Prior Art

Traditional building construction has in the past involved the use of cinder blocks formed out of cement which are transported to a job site and are arranged in a standard stacking fashion with the use of a building morter to construct a wall structure. While providing an effective means for constructing a wall, such cinder block assemblies are noted to be fairly highly temperature conductive in that they easily transfer both heat and cold through the wall to the surrounding environs. This fact has recently become more appreciated in view of the higher efficiency heating and cooling systems which are now in use.

Over the past several years, conventional cinder blocks have been replaced to an extent by highly insulated building blocks constructed out of a plastic or expanded polystrene. The purpose of such materials is to provide greatly increased thermal insulation or R values to the construction in an attempt to limit the loss of heat and cool air conductivity through the walls of the structure, particularly the foundation. The building blocks have a desired length, width and height and are typically hollowed internally in some desired fashion so that, upon stacking the blocks together, the hollowed internal portions form continuously extending horizontal and vertical channels for receiving a poured concrete. In this fashion, a wall structure can be effectively constructed of the form patterns and the concrete reinforcing added as a final construction step. Examples of such form block structures are illustrated in the art in U.S. Pat. Nos. 5,123,222 and 5,014,480, issued to Guarriello et al., U.S. Pat. No. 5,024,035, issued to Hanson et al., and U.S. Pat. Nos. 4,894,969 and 4,884,382, both issued to Horobin.

There do however exist many disadvantages in the prior art forms, most notably among them being the relatively poor distribution of stress relieving points along the interior walls which define the liquid concrete filling channels and the inability to provide for efficient drainage of moisture which inevitably accumulates during the construction of the wall structure. Additional disadvantages of existing form patterns include the inability of the blocks to be installed in either a forward or reversed direction as well as the ability to hang drywall, fire wall sheeting or other materials in an overlaying manner directly to the foam construction. Other disadvantages include the inability of the internally formed channels in the form structure to be easily modified to account for corners, doorways, roof peaks and windows by preventing the flow of the concrete in certain directions as well as the provision of an exterior facing ledge support as a foundation for the construction of a brick wall along an exterior face of the form construction.

SUMMARY OF THE PRESENT INVENTION

The present invention is an interlocking and insulated form pattern assembly used in creating a wall structure for receiving a poured concrete. The pattern assembly is constructed of a plurality of individual form structures which have a generally rectangular shape defined by a height, width and length. A plurality of interiorly and arcuately formed walls in each structure define in combination longitudinally and vertically extending concrete filling passageways.

Alternating projecting and recessed portions in upper and lower faces of the form structures allow the form structures to be interlocked together according to a desired stacking arrangement so that the longitudinally and vertically extending and concrete filling passageways are interconnected and extend continuously throughout the constructed wall structure. Moisture drainage means are incorporated into the form structures and are defined by horizontally and vertically extending channels which, upon assembly of the stacking arrangement, likewise provide continuous interconnected passageways for the purpose of evacuating undesirable moisture to a footing and a drain tile base surrounding the bottom of the wall construction footing.

Upon completion of the wall construction, the concrete is poured through selected openings in the top most forms and into the stacked arrangement until it fills the communicating filling passageways. The configuration of the arcuately shaped walls which create the concrete filling passageways is such that the loading forces and stresses resulting from the pouring of the concrete are evenly distributed across the entire interior surface area of the block construction and assists in preventing damage or blow out to the assembled wall construction.

Additional inventive features include the provision of a brick ledge insert which secures to a base of the stacked arrangement and, upon application of the concrete filling, causes the concrete to form a flat exterior base surface upon which a brick wall may be constructed. Internal attachment strips may be incorporated into the stacked form structures so that other items such as dry wall or fire strips may be mounted against either or both faces of the constructed wall. Specially constructed form structures are also provided for accounting for corners and end pieces of the wall and dam inserts may be selectively engaged within like configured apertured portions within the forms to restrain the flow of the concrete in areas where it is desired to form a doorway or window opening.

BRIEF DESCRIPTION OF THE DRAWINGS

Reference is now made to the attached drawings, when read in combination with the following specification, wherein like reference numerals refer to like parts throughout the several views, and in which:

FIG. 3 is a cutaway view taken along line 3—3 of FIG. 1 and illustrating the support members for suspending the horizontally extending reinforcing bars as well as a first preferred embodiment for attaching a drywall or firewall material according to the present invention;

FIG. 4 is a cutaway view taken along line 4—4 of FIG. 1 and illustrating an internally extending nylon attachment strip for attaching a drywall or firewall material according to a further preferred embodiment of the present invention;

FIG. 5 is a cutaway view taken along line 5—5 of FIG. 1 and illustrating a top view of adjoining form structures with arcuately shaped inner walls which are filled with a poured concrete;

FIG. 8 is a side view in cutaway of the brick ledge insert in operative engagement and illustrating the manner in which the poured concrete establishes the flat exterior base surface for providing the foundation for construction of the brick wall;

DETAILED DESCRIPTION OF THE PREFERRED EMBODIMENTS

Figure 1:
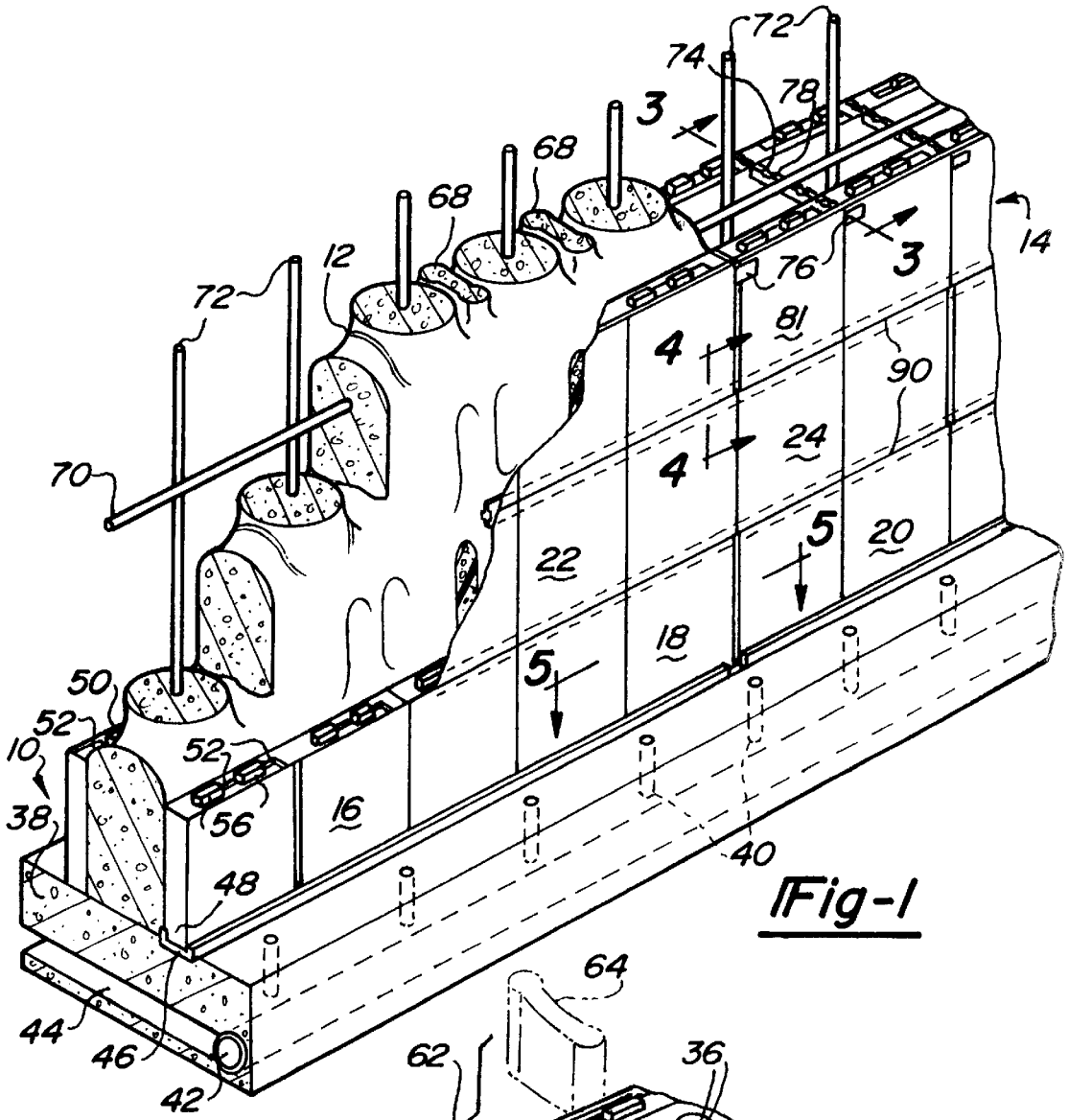
FIG. 1 is a perspective view in partial cutaway of the interlocking and insulated form pattern assembly for creating a wall structure according to the present invention.

Referring to FIG. 1, an interlocking and insulated form pattern assembly 10 is shown for receiving a poured concrete 12 in order to construct a wall structure 14 according to the present invention. The pattern assembly 10 is made up of a plurality of individual form structures, illustrated in FIG. 1 as 16, 18, 20, 22, 24, etc., according to a stacking arrangement which will be subsequently described. The form structures can be constructed of a variety of materials, but are preferably an expanded polystyrene (EPS) insulation which exhibit the necessary properties of impact resistance and durability. The high insulating effect of these form structures according to this construction results in a high insulation retaining R-value as will also be discussed.

Figure 2:
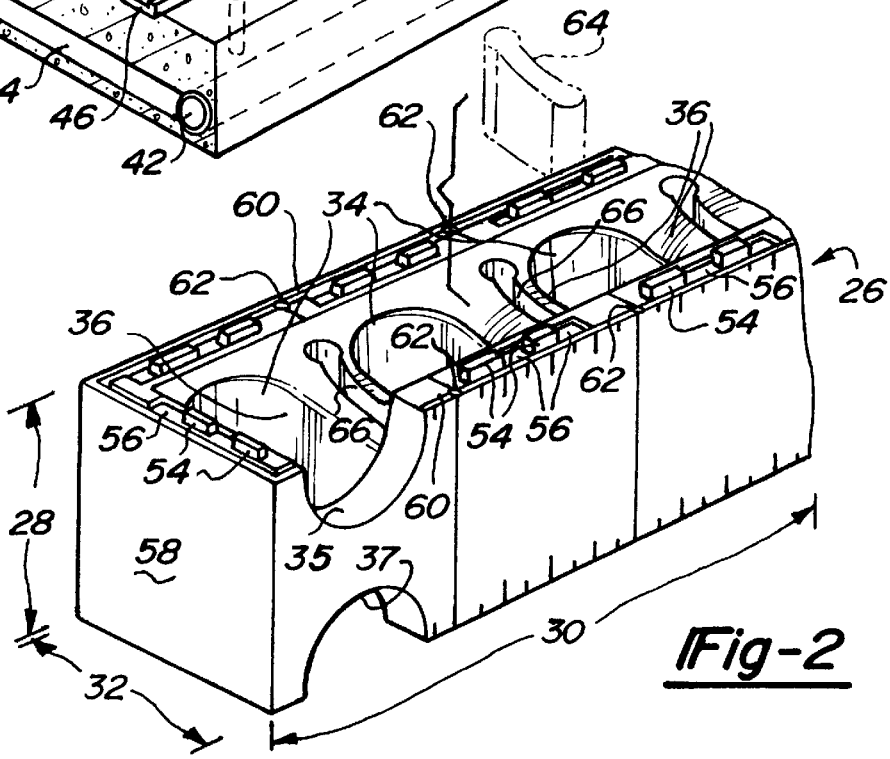
FIG. 2 illustrates a partial view in perspective of a corner block used in the form pattern assembly according to the present invention and further shows a damming insert in phantom for restraining the flow of poured concrete in a given direction.

The forms 16, 18, 20, 22, 24, etc., according to the view of FIG. 1 are standard interconnecting forms used in creating a wall structure. Each of the form structures is provided in a substantially rectangular configuration having a height, a length and a width. Referring further to FIG. 2, a corner form structure 26 is illustrated in partial view and generally includes a height 28, length 30 and width 32.

The corner form structure 26, the standard form structures 16, 18, etc., and all other of the form structure variations to be subsequently described each include a plurality of interiorly and arcuately formed walls which, in combination, define vertically and longitudinally concrete filling passageways accessible from the top and bottom sides of the forms. Specifically, referring again to FIG. 2, arcuately shaped side walls 34 and arcuately shaped central walls 36 are formed within the form 26 which are accessible from the top and bottom of the form to receive a pour of a concrete in liquid form in order to fill the passageways formed in the respective forms to create the concrete reinforcement to the erected wall structure.

With reference also to the other figures to be subsequently described it can be seen that the arcuately extending walls create substantial interconnecting passages within the form structures so that the forms are substantially internally hollowed and receive a considerable amount of concrete. Particular to the form 26 of FIG. 2 are curved end walls 35 and 37 extending semi-circularly from the top and bottom edges of the form which communicate the poured concrete filling into an adjacent form (not shown) which would be placed in alignment with the end face of the form 26. Further discussion of the manner of filling the concrete into the form assembly of the invention will be subsequently made.

Referring again to FIG. 1, a footing 38 is laid in a fashion and manner according to the outline of the structure to be erected. The footing 38 usually is constructed according to conventional dimensions and standards. As a modification to the footing 38, a series of vertically extending drain apertures 40 may be provided within the footing which run off into a horizontally extending drain pipe 42 and subsequently to an outwardly facing, recess 44 in the footing 38. The outwardly facing recess 44 is surrounded by a drain tile of charcoal, rocks or the like (not shown) which are conventially used as a surrounding substrate to a structure for the purpose of facilitating drainage. The importance of the drainage means built into the footing 38 will be subsequently appreciated upon further explanation of the drainage capability of the form structures.

Referring again to FIG. 1, a locating shoe 46 extends axially along the footing 38 and receives a corresponding axially extending bottom portions 48 of the lowest row 16, 18 and 20 of the form structures in order to arrange the row of form structures in proper alignment. Once the lowest row of form structures is in place, a wall structure can be erected according to a desired stacking arrangement due to the interlocking nature of the forms which will now be described.

As can be seen in both FIGS. 1 and 2, extending axially along the opposing sides of the top and bottom surfaces of the form structures are pluralities of alternating projecting and recessed portions. Specifically, form structure 16 of FIG. 1 illustrates projecting portions 50 and recessed portions 52 arranged in an axial and alternating fashion along the opposing top surfaces of the form 16 and the corner form 26 of FIG. 2 likewise illustrates projecting portions 54 and recessed portions 56 form both along the opposing sides as well as an end wall 58 forming a 90° bend to the form structure. Although not clearly illustrated in the Figures, it is understood that identically formed projecting and recessed portions are formed in the undersides of the form structures which constitute the intermediate layers between the top and bottom layers in order to complete the stacking arrangement.

As is illustrated in FIG. 1, the form structures are continuously stacked in a desired fashion so that they create the wall structure illustrated. The form structures may be stacked in any fashion desired, however they are preferably arranged in an offset fashion as is well know in the art so that the various forms lend reinforcing support to each other. The stacking arrangement of the various forms, whether offset or in aligned fashion, results in the vertically and longitudinally extending passageways being interconnected and extending continuously throughout the wall structure created so that the poured concrete 12 completely permeates each and every passageway within the forms to provide solid reinforcing support to the structure.

A drainage system is built into the form structures making up the assembly of the present invention for evacuating moisture to the outside of the structure which result both from the water present in the poured concrete and unrelated and subsequent environmental conditions surrounding the wall structure. The drainage system includes interconnected horizontal and vertical extending drainage channels formed in opposing longitudinally extending sides of the form structures. Specifically, referring to the corner block form 26 of FIG. 2, horizontally extending drainage channels 60 having a semicircular cross section extend longitudinally along the parallel extending edges of the forms. Vertically extending channels 62 communicate with the horizontally extending channels 60 at selected intervals along the longitudinally extending channels 60 and run the vertical length of the form 26 at which point they communicate either with an aligned set of horizontally and vertically extending channels in a lower succeeding form or they drain directly into the drain apertures 40 of the footing 38 for evacuation outside the wall structure.

Referring again to FIG. 1, the stacking arrangement of the form structures, whether offset or symmetrical, results in the drain channels, as well as the concrete filling passageways, always being in communicating alignment so that additional water may run off the structure both during the pouring stage of the concrete and as a result of subsequent conditions such as flooding caused by excessive rain. While not referenced at each form for purposes of ease of illustration, the horizontally and vertically extending drainage channels are shown extending continuously throughout the opposing sides of each form and, in combination, create an overall drainage system which efficiently disposes of undesirable moisture accumulations.

Once the wall structure according to the form assembly 10 is constructed, the concrete material is poured through a selected opening in one of the upper most row of forms until the concrete completely fills the interconnected passageways and is fairly level with the tops of the uppermost row. In certain instances where there are a fairly large number of vertical rows of forms, it is sometimes desirable to make a first pour concrete after the first several rows are assembled in place and then to complete the reinforcement by making a second pour after the remaining rows are stacked together.

Referring once again to FIG. 2, it is desirable at certain locations to prevent the flow of concrete in order to cut away a portion of the erected wall structure in order to create certain apertures, most notably for receiving a window or doorway or for creating a roof peak. This is typically accomplished by a damming insert 64 which is slidably engaged within a like shaped damming aperture 66 within the form structure 26. The damming apertures 66 are located within the arcuately shaped central walls 36 and, upon sliding engagement of the insert 64, effectively dam off the longitudinally extending passageway of the form or forms so that concrete will not fill beyond a certain point. The damming apertures are typically included in each type of form structure and, referring to FIG. 1 once again, contours 68 in the cutaway of the poured concrete are representative of apertures in the form assembly which are not dammed.

Referring again to FIG. 1 and also to FIG. 3, pluralities of elongated and horizontally extending reinforcing bars 70 as well as vertically reinforcing bars 72 are illustrated for providing additional reinforcing support to the form assembly concurrent with the pouring of the concrete reinforcement. Referring to the cutaway view of FIG. 3, a plurality of supporting members 74 are provided which are constructed so that they may be hung to extend across the open interior of the selected form structure and to provide suspending support to the horizontally extending reinforcing bars 70. The support members 74 are slidably inserted into crevices formed between adjoining forms as is shown in FIG. I and are each provided with a planar end face 76 which projects beyond the inner faces of the form structures and a plurality of semicircular recesses 78 are located at intervals along its length which receive the horizontally laid reinforcing bars 70, as is further best shown in FIG. 2.

One or more of the horizontally extending bars 70 are typically supported in parallel upon the support members 74 laid within the forms prior to the pour of concrete. The vertically extending bars 72 are usually inserted into the concrete a predetermined period of time after the pour has occurred and this step is carefully timed so that the concrete is given a chance to solidify to a degree necessary to support the rod in a fixed, upwardly extending manner while still being of a sufficiently fluidic state to receive the rods 72. FIG. 1 best shows the perpendicularly extending nature of the support rods 70 and 72 which combine to provide additional reinforcing support to the form and concrete assembly and to assist in absorbing stresses in the assembly as well as helping to prevent blowout of the wall during construction.

A first preferred embodiment is illustrated in FIGS. 1 and 3 for attaching a drywall, firewall or other type of sheeting material over an inner face of the wall construction. Specifically, looking at the cut away side view of FIG. 3, a sheeting material 80 is arranged so as to extend in a planar and overlaying fashion relative to the inwardly facing surface of the form assembly, illustrated as being an additional form 81 arranged in the stacked arrangement above forms 22 and 24. As previously described, the sheeting material 80 may either be drywall or firewall material and is positioned so that an abutting face 82 of the material 80 contacts the inwardly projecting and planar end faces 76 of the support members 74. A set of mounting fasteners, such as screws 84 are drilled into the wall, such as through apertures 86 so as to mount the sheeting material 80 directly to the planar end faces 76. Because the drywall or firewall material is mounted directly to the planar end faces 76 of the support rods, which are usually metal, this is considered to be a fire retardant installation.

Referring again to FIG. 1 and also to FIG. 4, another preferred embodiment is illustrated for mounting a drywall or firewall material 88 over an inner face of the wall construction. According to this embodiment, pluralities of longitudinally extending nylon strips 90 and 92 are embedded within the inner and outer faces respectively of the forms. Specifically referring to FIG. 1, two longitudinally extending strips 90 are illustrated in phantom within the inner face of the forms and extend in a level fashion between upper and lower horizontal rows of the forms in alignment with the upper and lower interlocking surfaces of the rows of forms. Referring again to FIG. 4, one of the embedded nylon strips 90 is shown in cross section embedded between the lower form 24 and consecutively stacked form 81. Also illustrated in cross section is a nylon strip 92 likewise embedded between the contacting upper and lower interlocking surfaces of forms 24 and 81, respectively, in an inwardly spaced manner from the outside face of the wall construction.

The corresponding upper and lower faces of the form structures are formed to easily receive the longitudinally extending nylon strips 90 and 92 in their embedded fashion during the construction of the form assembly. Upon completion of the construction, mounting screws, illustrated in the side view of FIG. 4 at 94, are rotatably driven into the sides of the forms to mount the drywall or firewall material in place. Proper engagement of the screws with the nylon strip or ribbon material is ensured because the strip is in horizontal alignment with the seam created between the upper and lower rows of forms and the nature of the nylon material is such that it fixedly retains the sheet stock material in place. Again, while only an inner face of the construction is shown for receiving the sheet material 88, it is understood that both the inner and outer faces of the wall construction can be covered due to the existence of the additional plurality of nylon strips 92 located proximate to the outer face.

Referring again to FIG. 1 and also to FIG. 5, a top view 96 is illustrated in cutaway between the form structure 18 and succeeding form structure 20 which constitute the initial row of form structures which make up the form assembly. The purpose of the view of FIG. 5 is to illustrate the arcuate and rounded contours of the arcuately shaped side walls 34 and central walls 36 which in combination form the circular cross sectional receiving cavities for the concrete 12 as well as the alternating poured concrete contours 68 resulting from the damming apertures which are left open during the concrete pouring stage.

As is best illustrated in this view, the rounded holes and contours in the forms serve to widely distribute the stress and impact forces resulting from the pouring of the concrete and this results in much better shock absorption and decreased incidence of fracture of the forms or stress blow out of the assembly during the very important concrete filling stage. A seam 98 between the horizontally abutting forms 18 and 20 is illustrated and further shown are the vertically extending channels 62 for evacuating moisture from within the assembly and through the footings and surrounding drain tile.

Figure 6:
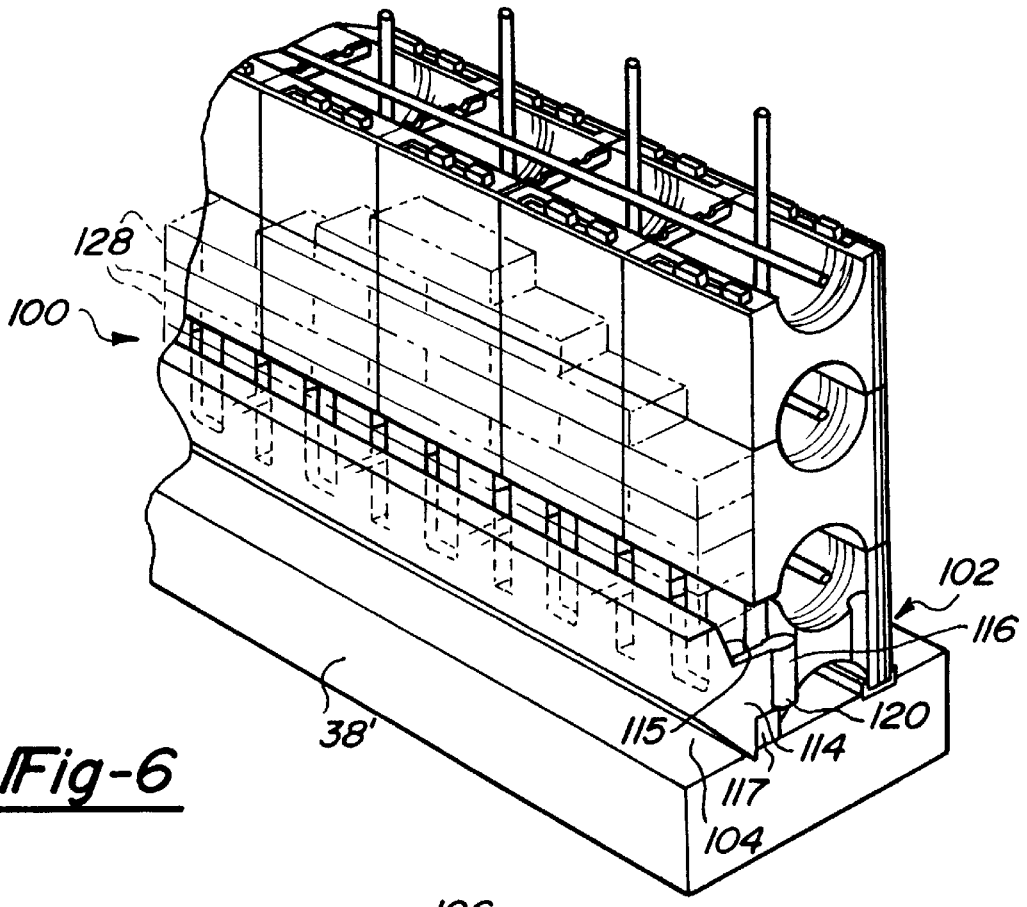
FIG. 6 is a perspective view in partial cutaway and showing a brick ledge insert attached a lowermost row of form structures and supported upon a base for enabling the construction of a brick wall.
Figure 7:
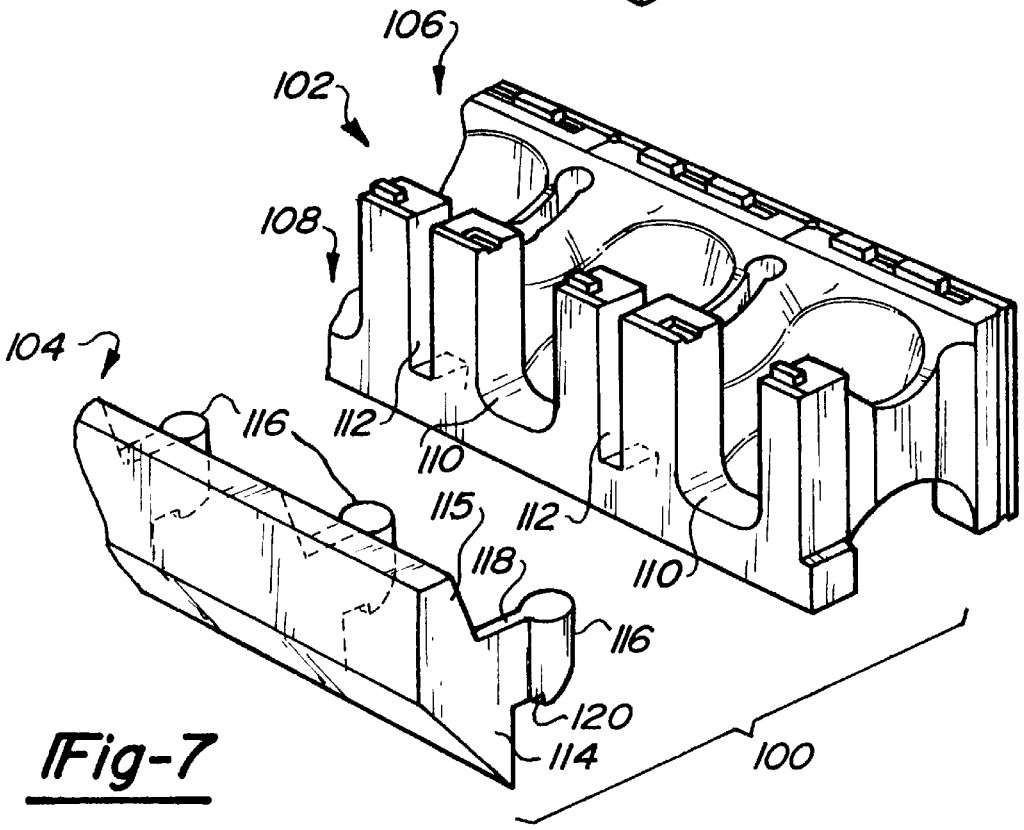
FIG. 7 is an exploded view of the brick ledge insert and the configuration of the bottom row form structures according to the present invention.

Referring now to FIGS. 6–8, a further modification 100 of the form pattern assembly of the present invention is illustrated an includes a modification 102 of the lowest row of form structures which enables the pattern assembly to receive a brick ledge insert 104. As is best shown in the exploded view of FIG. 7, the modified forms 102 include close faced inner sides 106 which are constructed in standard fashion and openly slotted outer sides 108 which enable the modified forms 102 to accept the brick ledge insert 104. Specifically, alternating pluralities of slotted portions 110 and 112 are formed vertically in the outer sides 108 from an upper end of the forms 102 to a predetermined point above the base of the forms. The slotted portions 110 are preferably on the order of 6" in width and the slotted portions 112 approximately 1½" in width.

The brick ledge insert 104 includes a longitudinally extending and contoured body portion 114 with an outwardly angled face 115 opposite the form and a generally cylindrically shaped engaging portion 116 which is spaced horizontally outwardly from the body portion 114 by a thin cross sectional webbed portion 118. The construction of the ledge insert 104 and modified forms 102 is such that the engaging portions 116 are recessed inwardly of the outer sides 108 so that the thin cross section webbed portions 118 align between the smaller slotted portions 112 and the insert 104 is then pushed downwardly until the webbed portion 118 abuts the bottom of the slotted portions 112. A bottom of the cylindrical engaging portion 116 is downwardly stepped along its inner face, at 120, so that the ledge insert is locked in place relative to an aligning projecting portion 117 of the forms 102 and will not tip outwardly during the concrete pouring stage.

Referring again to FIG. 8, a side view is illustrated of the brick ledge insert 104 mounted to the modified form 102 for establishing a flat exterior concrete base surface 122. During the concrete pouring stage, concrete fills the base row of modified forms 102 according to the arrows 124 and proceeds through the slotted portions 110 and 112 as shown by arrows 126 into the trough established between the brick ledge insert 104 and forms 102. Concrete fills the trough to the surface level 122, at which point the filling forces become equalized and the concrete thereafter fills upwardly within the stacked forms. As is also shown in FIG. 6, a plurality of bricks 128 are stacked upon an upper face 130 of the insert 104 and the concrete surface 122 which is usually level with the upper face 130 in order to construct a brick wall on the exterior face wall construction. A modification 38' of the footing is also illustrated in FIG. 6 for supporting the wall construction and attaching ledge insert and the form assembly is otherwise configured and assembled in the same fashion as previously described.

Figure 9:
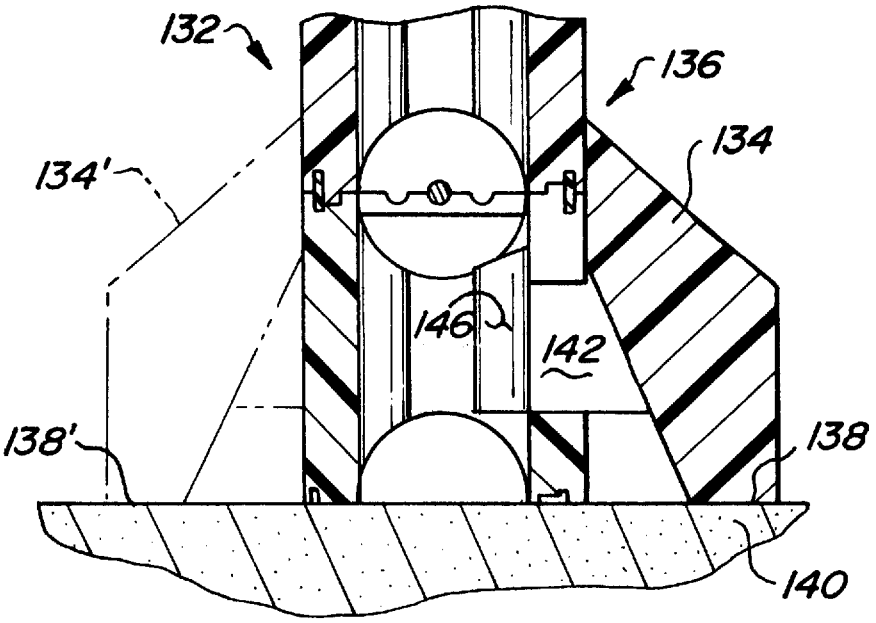
FIG. 9 is a side view similar to FIG. 8 and illustrating the brick ledge insert in an inverted position and functioning as a footing according to a further preferred embodiment of the present invention.

Referring now to FIG. 9, a further modification 132 is shown of a footing structure for supporting the form pattern assembly according to the present invention. A modification of the brick ledge insert 134 is illustrated in solid extending from a first face of a modified form 136 and in phantom 134' optionally extending from the other face. The insert 134, 134' is in an inverted position according to this embodiment and interlocks with likewise configured slotted portions formed in the modified form (not evident from this view) so that a foot 138, 138' of the insert 134, 134' is supported upon a planar ground surface 140.

A cylindrical engaging portion 140 is connected to the ledge insert 134 by a webbed portion 142 in a fashion similar to that illustrated in FIGS. 6–8 by sliding the engaging portion 140 and webbed portion 142 through the narrower of the slotted portions (see slotted portions 112 of FIG. 6). The embodiment of FIG. 9 typically utilizes a standard brick ledge insert and modified form as shown in FIGS. 6–8 with the exception that it is inverted for use as a footing. It is also desirable in these instances to use inverted ledge inserts as footings on both sides of the form assembly for providing increased structural integrity.

Figure 10:
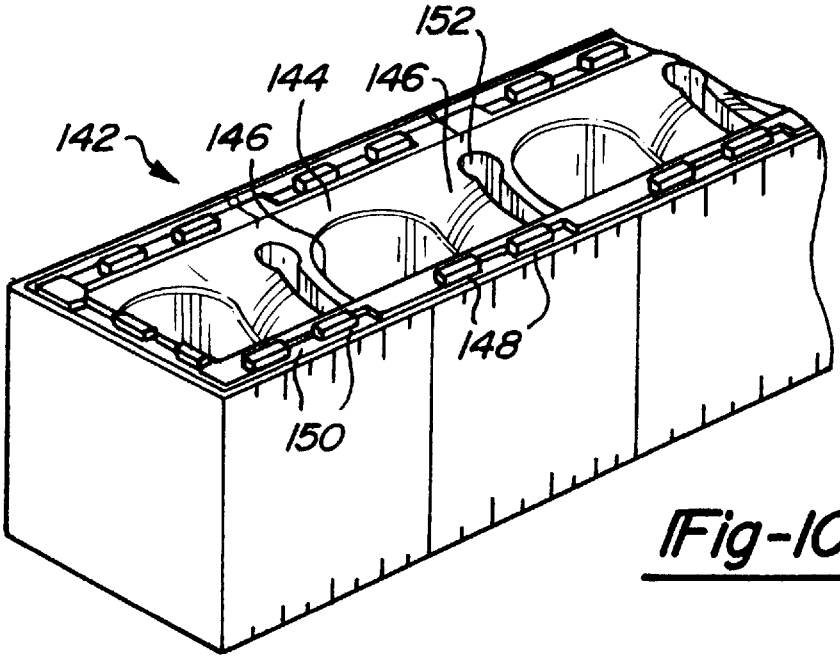
FIG. 10 is a partial view in perspective of an end block used in the form pattern assembly according to the present invention.

Referring to FIG. 10, a closed end form modification 142 of the form pattern assembly is illustrated and includes such features as the arcuately shaped side walls 144 and central walls 146 for creating the concrete filling passageways, the alternating projecting 148 and recessed portions 150 for creating the interlocking stacking means and the damming apertures 152 for selectively cutting off the flow of the poured concrete. An additional feature illustrated in the modification 142 are the placement of external molded measuring marks 154 on sides of the modified blocks 142 to allow for easy measurement and for cutting of the blocks into desirable lengths.

Figure 11:
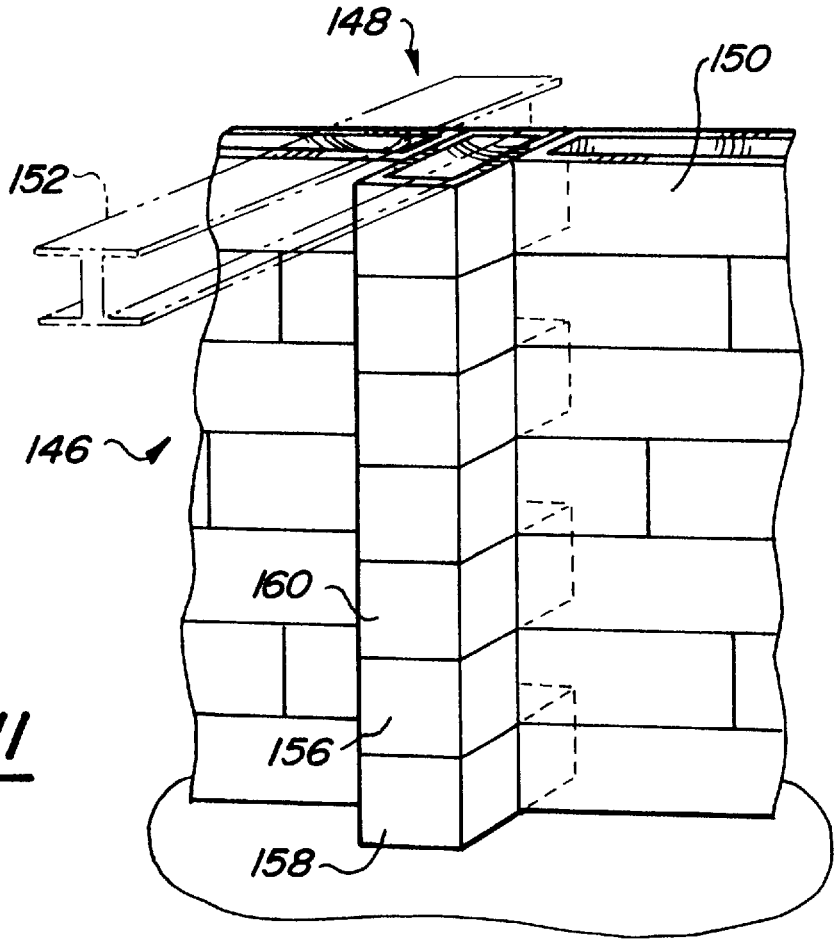
FIG. 11 is a view in perspective of a pilaster block construction in a wall erected by the form assembly according to the present invention.
Figure 12:
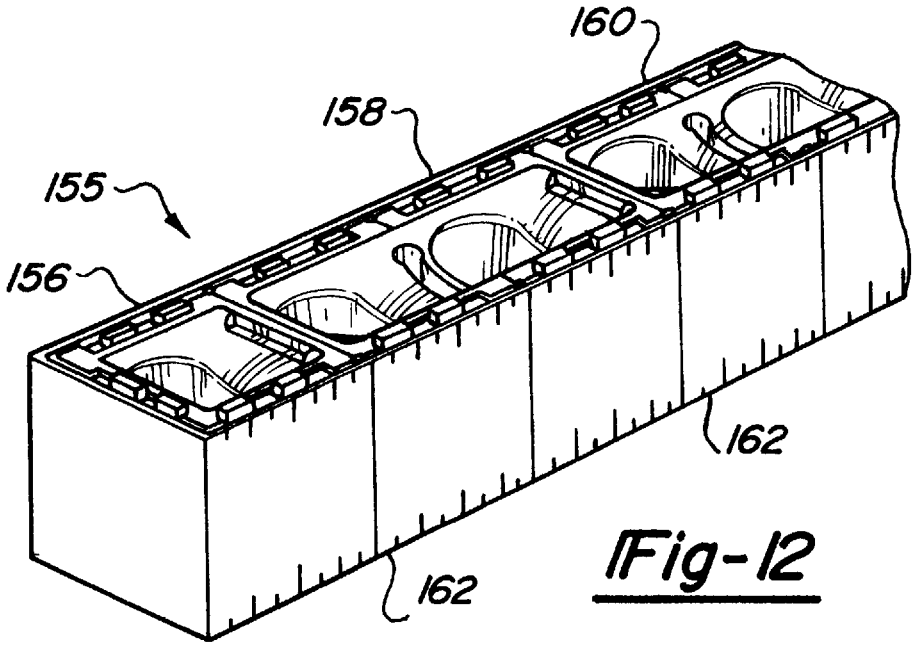
FIG. 12 is a partial view in perspective of a continuous pilaster block for use in creating a reinforcing pilaster construction according to the present invention.

Referring finally to FIGS. 11 and 12, a reinforcing or "Tee" construction 146 (FIG. 11) is illustrated for providing reinforcing wall support at an intermediate location 148 in a wall construction 150. Such support is desirable for providing vertical reinforcing support to an I-beam 152 or other cross beam support. Referring to FIG. 12, a pilaster form structure 155 is illustrated which is capable of being subdivided into desired lengths for creating the wall construction 150. The form 155 includes single block column support portions 156 and double block construction portions 158 and 160.

Referring back to FIG. 11, it is evident as to how the pilaster forms 155 are subdivided to create the reinforced intermediate location 148 in the wall 150. This is accomplished by subdividing the pilaster form 155 at the measurement marks 162 illustrated in FIG. 12. The double block 158 is laid in a perpendicular fashion relative to the initial row of form structures and the single block support portion 156 is set atop the perpendicularly projecting portion of the double block 158. The double block 160 is subsequently laid in the third row of form structures in a repeat of the pattern established by the block 158 so that it interlockingly engages the top of the single block 156.

As is readily apparent from FIG. 12, the modified pilaster block form 155 is constructed in the same fashion as the closed end form 142, corner form 26 and standard forms 16, 18, 20, 22 and 24. Consequently, upon arrangement of the wall construction 150 according to FIG. 11, the poured concrete fills the passageways formed in the projecting and reinforcing support portions at the intermediate location 148 of the wall 150 and creates an adequate reinforcing foundation for the I-beam or other desired reinforcing support member.

It is therefore apparent from the review of the several embodiments of the form construction described herein that the form pattern assembly according to the present invention is a marked improvement over previous form constructions. Specifically, nothing in the prior art teaches or suggests the provision of a moisture drainage system built into the form construction, the alternating nature and reversibility of the interlocking portions, or the rounded arcuate shape of the passage forming walls for effectively distributing the impact forces and stresses during the concrete pouring stage. Additional features such as the brick ledge support and the reinforcing bar supporting rods and manner of attaching drywall and firewall are also not shown in the art.

Additional embodiments will become apparent to those skilled in the art to which the invention pertains without deviating from the scope of the appended claims.

I claim:

1. An interlocking and insulated form pattern assembly used in creating a wall structure for receiving a poured concrete, said form pattern assembly comprising:

a first integrally molded and durable form structure having a substantially rectangular configuration with a height, a length and a width, said first form structure further including a plurality of interiorly and arcuately formed walls which define in combination vertically extending concrete filling passageways and longitudinally extending concrete filling passageways;

interlocking means for securing said first form structure in an aligned fashion to additionally and identically construct form structures according to a specified stacking arrangement so that said vertically extending passageways and said longitudinally extending passageways extend continuously throughout said stacking arrangement, said interlocking means including alternating projecting portions and recessed portions extending longitudinally along first and second sides of said rectangularly configured form structure and from both upwardly facing surfaces and corresponding downwardly facing surfaces of said form structure so that a selected form structure is capable of being reversibly engaged with at least one further selected form structure; and moisture drainage means extending both horizontally and vertically within said first form structure and communicating with additional moisture drainage means formed in said identically constructed form structures to create interconnected horizontally and vertically extending drainage channels in said stacking arrangement of form structures, said moisture drainage means including a first plurality of horizontally extending and opposingly mating recessed drainage channels formed along said upwardly and downwardly facing surfaces of each of said selected and stackable form structures, said first plurality of drainage channels communicating with a second plurality of vertically extending drainage channels established within solid wall portions of each of said form structures at spaced apart intervals and in proximity to said first and second sides to create an overall drainage network throughout said wall structure;

said stacking arrangement of form structures receiving a poured concrete to fill said vertically and longitudinally extending concrete passageways of said forms, said drainage network being capable of evacuating moisture from within said wall structure of said forms to a footing upon which said form assembly is constructed.

2. The form pattern assembly according to claim 1, further comprising interlocking means projecting from upper surfaces of an initial row of form structures, additional interlocking means extending from both upper and lower surfaces of subsequent vertically upwardly stacked rows of form structures.

3. The form pattern assembly according to claim 1, further comprising, in combination with said form pattern assembly, a fluid evacuation means built into a footing upon which said form assembly is constructed, said evacuation means including a plurality of vertically extending drain apertures which are in fluidic communication with said moisture drainage means, moisture from said vertically extending drain apertures collecting into a horizontally extending drain pipe built into said footing which vents to a surrounding drain tile.

4. The form pattern assembly according to claim 1, further comprising a plurality of horizontally and vertically extending elongated reinforcing bars incorporated into said form pattern assembly and means for positioning and supporting said horizontally extending bars.

5. The form pattern assembly according to claim 4, further comprising a plurality of horizontal support members attached to said form structures so that said support members each extend across an open interior passageway of said associated form structure, said support members each further including a planar end face and a plurality of spaced apart semi-circular recesses for receiving said horizontally extending reinforcing bars.

6. The form pattern assembly according to claim 5, further comprising a drywall or firewall sheet material which is secured to said planar end faces of said support members by a plurality of mounting fasteners.

7. The form pattern assembly according to claim 1, further comprising a plurality of elongated and longitudinally extending vinyl attachment strips, each of said vinyl strips aligning with a seam established between a lower row of form structures and a succeeding upper row of form structures, said vinyl strips being recessed a predetermined distance inwardly from an outer face of said form structures and receiving a plurality of fasteners for mounting a drywall or firewall material to said form pattern assembly.

8. The form pattern assembly according to claim 1, further comprising a brick ledge insert and a modified lower row of form structures for creating a foundation for laying a brick wall adjacent said wall structure, said modified lower row of forms including close faced inner sides and vertically slotted outer sides for engaging said insert.

9. The form pattern assembly according to claim 8, said brick ledge insert further comprising a contoured body portion including an outwardly angled face and an engaging portion extending from said outwardly angled face and secured to said insert by a webbed portion.

10. The form pattern assembly according to claim 9, further comprising a trough established between said outwardly angled face of said brick ledge insert and said outer sides of said forms upon slidably engaging said engaging portions of said insert with said slots in said forms, said poured concrete establishing a flat brick ledge support surface for providing a foundation for laying a brick wall adjacent said form assembly.

11. The form pattern assembly according to claim 1, further comprising an inverted brick ledge insert and a modified row of lower form structures having vertically slotted portions formed in at least one face thereof, said ledge insert including a contoured body portion, an engaging portion secured to said contoured body portion by a webbed portion, said engaging portion being received within said form slotted portions so that a foot portion of said inverted ledge insert is supported upon a ground surface.

12. The form pattern assembly according to claim 1, further comprising a plurality of damming apertures arranged in said form structures within said arcuately shaped inner walls, one or more damming inserts being inserted within selected ones of said damming apertures to selectively prohibit the flow of poured concrete in certain directions throughout said form assembly.

13. The form pattern assembly according to claim 1, further comprising a plurality of pilaster block form structures which are selectively subdivided and incorporated into said wall construction to establish a reinforcing Tee location for supporting an overlaying cross member.

14. The form pattern assembly according to claim 1, said concrete filling passageways incorporating rounded interior channels which evenly distribute throughout said form structures loading forces and stresses incurred during said concrete pouring stage.

15. The form pattern assembly according to claim 1, said form structures including a plurality of standard forms, closed end forms and corner forms, said corner forms including curved semi-circular end walls formed in a face thereof so that poured concrete filling into said corner form communicates with an adjacently placed form.

* * * * *